US008951311B2

(12) United States Patent
Rozelle et al.

(10) Patent No.: US 8,951,311 B2
(45) Date of Patent: Feb. 10, 2015

(54) METHOD AND SYSTEM FOR CONTROLLING A GASIFICATION OR PARTIAL OXIDATION PROCESS

(75) Inventors: Peter L. Rozelle, Forty Fort, PA (US); Victor K. Der, Gaithersburg, MD (US)

(73) Assignee: U.S. Department of Energy, Washington, DC (US)

( * ) Notice: Subject to any disclaimer, the term of this patent is extended or adjusted under 35 U.S.C. 154(b) by 1009 days.

(21) Appl. No.: 13/029,557

(22) Filed: Feb. 17, 2011

(65) Prior Publication Data

US 2014/0298724 A1 Oct. 9, 2014

(51) Int. Cl.
*B01J 7/00* (2006.01)
*C10F 7/02* (2006.01)

(52) U.S. Cl.
USPC ..... 48/61; 48/127.9; 48/127.1; 48/76; 48/67; 48/200; 48/201; 48/202; 48/203; 48/71; 48/72; 48/73; 44/633; 44/568; 44/628; 44/629; 34/586; 34/589; 34/384

(58) Field of Classification Search
CPC ..... C10L 9/08; C10L 5/44; C10L 5/48; C10L 1/06; C10L 5/361; C10L 9/02; C10B 53/07; C10B 55/02; B01J 19/087; C10J 2300/0943; C10J 2300/0973; C10J 2300/16; C10J 2300/1628; C10J 2300/1659; C10J 3/18; C10J 3/54
USPC ..... 48/61, 127.9, 127.1, 76, 200–203, 48/71–73; 34/586, 589, 384; 44/568, 44/628–629
See application file for complete search history.

(56) References Cited

U.S. PATENT DOCUMENTS

| | | | | |
|---|---|---|---|---|
| 3,961,913 | A * | 6/1976 | Brenneman et al. | 48/197 FM |
| 4,008,053 | A * | 2/1977 | Brenneman et al. | 48/197 A |
| 4,113,602 | A * | 9/1978 | Gorbaty et al. | 201/24 |
| 4,461,625 | A * | 7/1984 | Smith et al. | 431/12 |
| 5,134,944 | A * | 8/1992 | Keller et al. | 110/234 |
| 8,083,813 | B2 * | 12/2011 | Nair et al. | 44/300 |
| 8,211,274 | B2 * | 7/2012 | Ida et al. | 201/5 |
| 8,539,891 | B2 * | 9/2013 | Minkara et al. | 110/342 |
| 8,673,032 | B2 * | 3/2014 | French et al. | 44/607 |
| 8,747,495 | B2 * | 6/2014 | Ida et al. | 44/530 |
| 2008/0201980 | A1 * | 8/2008 | Bullinger et al. | 34/493 |
| 2010/0287826 | A1 * | 11/2010 | Hoffman et al. | 44/605 |

* cited by examiner

*Primary Examiner* — Kaity Handal
(74) *Attorney, Agent, or Firm* — Robert T. Burns; John T. Lucas

(57) ABSTRACT

A method and system for controlling a fuel gasification system includes optimizing a conversion of solid components in the fuel to gaseous fuel components, controlling the flux of solids entrained in the product gas through equipment downstream of the gasifier, and maximizing the overall efficiencies of processes utilizing gasification. A combination of models, when utilized together, can be integrated with existing plant control systems and operating procedures and employed to develop new control systems and operating procedures. Such an approach is further applicable to gasification systems that utilize both dry feed and slurry feed.

13 Claims, 4 Drawing Sheets

METHOD AND SYSTEM FOR CONTROLLING A GASIFICATION OR PARTIAL OXIDATION PROCESS

GOVERNMENT RIGHTS STATEMENT

The United States Government has rights in this invention pursuant to an employee-employer agreement with the U.S. Department of Energy.

TECHNICAL FIELD

Embodiments are generally related to the fields of gasification and partial oxidation processes Embodiments are also related to control systems for controlling gasification and/or a partial oxidation process. Embodiments additionally relate to systems that produce gas from a solid fuel.

BACKGROUND OF THE INVENTION

Gasification is a process that converts hydrocarbons such as coal, petroleum coke (petcoke), and biomass to a synthesis gas (syngas), which can be further processed to produce chemicals, fertilizers, liquid fuels, hydrogen, and electricity. Gasification is a flexible, commercially proven, and efficient technology that produces the building blocks for a range of high value products from a variety of low value feedstocks.

In general in gasification processes, a hydrocarbon feedstock is injected with oxygen and steam into a high temperature pressurized reactor until the chemical bonds of the feedstock are broken. The resulting reaction produces the syngas. The syngas is then cleansed to remove impurities such as sulfur, mercury, particulates, and trace minerals. (Carbon dioxide can also be removed at this stage.) The clean syngas is then used to make either a single product such as fertilizer or multiple products such as hydrogen, steam, and electric power.

Gasification is among the cleanest and most efficient technologies for the production of power, chemicals and industrial gases from hydrocarbon feedstocks, such as coal, heavy oil, and petroleum coke. Simply stated, gasification converts hydrocarbon feedstocks into clean synthesis gas, or syngas, composed primarily of hydrogen ($H_2$) and carbon monoxide (CO). In a gasification plant, the feedstock is mixed with oxygen ($O_2$) and they are injected into a gasifier. Inside the gasifier, the feedstock and the $O_2$ are subjected to a high-temperature and a high-pressure. As a result, the feedstock and the $O_2$ break down into syngas.

In addition to $H_2$ and CO, the syngas contains other gases in small quantities, such as ammonia, methane and hydrogen sulfide ($H_2S$). As much as 99% or more of the $H_2S$ present in the syngas can be recovered and converted to elemental sulfur form and used in the fertilizer or chemical industry. Ash and any metals are removed in a slag-like state, and the syngas is cleansed of particulates. The clean syngas is then used for generating electricity and producing industrial chemicals and gases.

Gasification allows refineries to self-generate power and produce additional products. Thus, gasification offers greater efficiencies, energy savings, and a cleaner environment. For example, some gasification plants may convert petroleum coke and refinery wastes into electricity and steam, making the refinery entirely self-sufficient for its energy needs and significantly reducing waste and coke handling costs. For these reasons, gasification has increasingly become popular among refiners worldwide. Currently, there are several hundred gasification plants in operation worldwide.

For these reasons, a need has been recognized for a control system capable of controlling various critical components of the gasification plant. A control system should improve the reliability of the gasification plant by reducing gasifier shut downs and maximizing run-time. Also, an ideal control system should reduce wear and tear of the gasifier and other associated components.

BRIEF SUMMARY OF THE INVENTION

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide for an improved gasification and partial oxidation method and system.

It is another aspect of the disclosed embodiments to provide for a control method and system for controlling a gasification and/or a partial oxidation process.

It is an additional aspect of the disclosed embodiments to provide for a method and system that produces a gasification product from a solid fuel.

The aforementioned aspects and other objectives and advantages can now be achieved as described herein. A method and system for controlling a fuel gasification system includes optimizing a conversion of solid components in the fuel to gaseous fuel components, controlling the flux of solids entrained in the product gas through equipment downstream of the gasifier, and maximizing the overall efficiencies of processes utilizing gasification. A combination of models, when utilized together, can be integrated with existing plant control systems and operating procedures and employed to develop new control systems and operating procedures. Such an approach is further applicable to gasification systems that utilize both dry feed and slurry feed.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION OF THE INVENTION

The particular values and configurations discussed in these non-limiting examples can be varied and are cited merely to illustrate at least one embodiment and are not intended to limit the scope thereof.

The disclosed embodiments provide for a method and system of controlling fuel gasification. Three goals can be achieved by the first approach. First, the disclosed embodiment an optimize the conversion of solid components in the fuel to gaseous fuel components. Second, the disclosed embodiments can be utilized to control the flux of solids entrained in the product gas through equipment downstream of the gasifier. Third, the disclose embodiments maximize the overall efficiencies of processes that utilize gasification.

The embodiments may be configured as a combination of models that, when utilized together, can be integrated with existing plant control systems and operating procedures and further used to develop new control systems and operating procedures. Such an approach is applicable to gasification systems utilizing both dry feed and slurry feed.

The embodiments are applicable to systems that produce a gas from solid fuel, which can then be used for steam raising, power generation, or the productions of other materials, such as fuels and chemicals. The process for producing the gas may be referred to as either "gasification" or "partial oxidation". Both of these processes will be subsequently herein referred to as "gasification".

Figure 1:
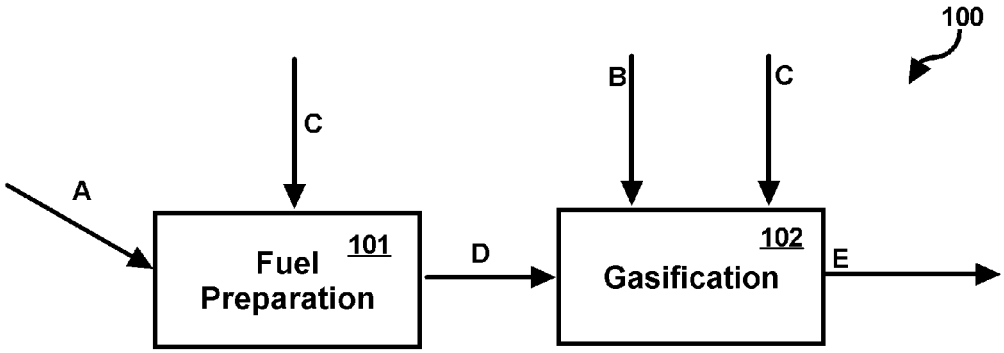
FIG. 1 illustrates a block diagram of a gasification system, in accordance with an embodiment.

FIG. 1 illustrates a block diagram of a gasification system 100, in accordance with an embodiment. The gasification system 100 generally includes a fuel preparation component 101 and a gasification component 102. A variety of streams are fed to and from the system 100. For example, as indicated in FIG. 1, a stream A of fuel and a stream C of water or steam can be fed to the fuel preparation component 101 as a part of the fuel preparation step. A stream D of prepared fuel then exits the fuel preparation component 101 and is fed as input to the gasification component 102. A stream B of oxidant may be fed to the gasification component 102 in addition to a stream C of water or steam. A stream E of gasification products will then result from processing of the gasification step or process via the gasification component 102.

FIG. 1 generally describes the gasification process. Referring to FIG. 1, the first step of gasification process involves rendering the characteristics of the fuel compatible with the gasification process. Such an operation generally involves modifying the particle size distribution of the fuel, and the use of one or more of the systems, which commonly referred to as "crushing", "grinding" and/or "screening". Such actions can take place as a part of the fuel preparation component or step 101. Note that some gasification systems may mix the fuel with water during the step C shown in FIG. 1. Such an operation is commonly referred to as "slurry fed" gasification. In turn, the associated gasification system may be referred to as a "slurry fed" gasification system.

The system 100 thus includes a fuel preparation step or component 101 and a vessel or set of vessels provided by the gasification component 102, which may also be referred to herein as the gasification step, wherein components in the fuel, including carbon and hydrogen, react with gaseous species and are themselves converted to gaseous species. During their residence time in the gasification step or component 102, the fraction of the solids that are converted to a gaseous species is herein referred to as the conversion.

The conversion of the solids to gaseous species in the disclosed systems is a parameter that is critical to the economics of a system equipped with gasification. A high level of conversion is desirable. If the conversion level is too low, solid fuel requirements may increase, effluent solids from the system may need to be recycled, and either or both conditions can result in undesirable effects on plant equipment.

Following implementation of the fuel preparation step via the fuel preparation component 101, the prepared fuel stream D is fed to the gasification component 102 for the gasification step associated with component 102. The oxidant stream B is also fed to the gasification step or component 102. The oxidant of stream B may be, for example, simply air, or may be oxygen enriched, with an oxygen concentration as high as, for example, 98 mole %.

As indicated above, water or steam can also be fed to the gasification step or component 102 via stream C. This can be accomplished, as previously mentioned, by adding water during the fuel preparation step of component 101, or by adding water or steam directly to the gasification step or component 102.

In the gasification step of component 102, oxygen from stream B is consumed through reaction with the feed solid from stream D. Water is generally been introduced with stream C and is also produced by reaction of the oxygen in the oxidant with hydrogen in the fuel. Carbon dioxide is produced by the reaction of the oxidant with carbon in the fuel. As the solids proceed through the gasification step, they react further with the water vapor and carbon dioxide present to produce carbon monoxide and hydrogen. The gasification products then exit the gasification step/component 102 via stream E. Stream E typically includes carbon monoxide, hydrogen, water, carbon dioxide, and nitrogen, all present in the gas phase. Solids are also present in the stream and can include ash-forming mineral constituents as well as un-reacted carbon. Minimizing the un-reacted carbon in the stream is essential to optimum operation of the system 100.

The solid carbon present in the gasification products is generally a function of the residence time of the solids in the gasification step of component 102, along with reaction kinetics in the gasification step, and the properties of the fuel fed to the system with Stream D.

The extent of reaction of the solids in the system 100 is controlled by residence time, reaction kinetics, and feed solids properties. In the case of solid fuels, notably coal, biomass, and petroleum coke, the feed solids (e.g., stream D) will not be uniform and will exhibit a particle size distribution. Note that this is in turn a function of the properties of the solids fed with Stream A to component or step 101 and fuel preparation step of component 101 acts on these solids.

The solids in Stream D may also exhibit distributions in density (herein referred to as specific gravity). Some solid fuels will exhibit significant variations in chemical composition with specific gravity.

A key to predicting gasification behavior in the gasification step of component 102, and its effect on the composition of stream E, involves taking into account the heterogeneity of solid fuels. The disclosed embodiments discussed herein generally employ a particle population model, which divides the feed solids into increments of particle size and specific gravity, evaluates their behavior in the gasification system separately, and then sums the results to develop a composite predicted behavior. The key parameter in the output is the unconverted combustibles, which is the fraction of combustibles in the solids present in stream D that are present in stream E. Such a model can be referred to as the particle population gasification model.

The particle population gasification model first divides the feed solids into particle size and specific gravity increments. It then adjusts the mass of the feed solids in each increment for the loss of volatile matter upon introduction to Step 2, followed by weight loss due to combustion and gasification reactions. It then sums the results the output is a composite combustible distribution in Stream E.

Also employed with the disclosed embodiments is a grinding model. Such a grinding model predicts the distribution of properties in stream D based on the properties of fuel stream A and the grinding stimulus itself. As an example, for the class of grinding system known commonly as "low speed" mills (e.g., ball mills or rod mills), this type of model applies a breakage rate function, a breakage distribution function, and a function of residence time of the solids in the grinding system, In the case of a slurry fed gasifier, a third model may be utilized, a viscosity model. This model predicts the viscosity of the slurry produced in Step 1 and is used to maintain the viscosity of stream D to prevent plant operating problems. The particle population model uses a form as indicated by equation (1) below:

$$\Gamma_E = F_D \sum_x \sum_y M(x, y)C(x, y)[1 - L(x, y)] \quad (1)$$

Where:

$F_D$ represents the flow rate solids to Step 2 in Stream D.

M(x,y) represents the mass fraction contributed to the overall particle population by particle size increment x and specific gravity increment y.

C(x,y) represents the combustibles fraction of particle size increment x and specific gravity increment y.

L(x,y) represents the mass lost, in step 2, by the fraction of the particle population in particle size increment x and specific gravity increment y.

$\Gamma_E$ represents the predicted flow rate of combustibles out of the system.

The grinding model may include models of the previously mentioned subsystems constituting the fuel preparation step, such as for example, the case of a closed system grinding, and may include models that describe both particle size reduction and particle size separation. The model of the particle size reduction itself includes components such as a breakage rate function, a breakage distribution function, and mill parameters. In the case of the low speed mills, these parameters include solids feed rate, water feed rate (if applicable), grinding medium charge, and energy applied to the mill. The development of the type of model is discussed, for example, in the reference: Austin, L. G., "Introduction to the Mathematical Description of Grinding as a Rate Process", *Powder Technology*, Volume 5, 1971/1972, pp. 1-17, which is incorporated herein by reference in its entirety and is referred to as the "Austin, L. G." reference.

Where specific gravity distribution is required for the particle population development (as is the case with coal), the model can be modified. Typical breakage rate functions are based on particle size only. The invention outlined here includes a new component, adding a specific gravity distribution to the particle size distribution developed by the model. This may be accomplished by carrying out float sink separations of the particle size fractions of the mill products, and the particle size distribution thus produced by the model is used as input to the particle population gasification model.

The viscosity model is an adaptation of the Furnas "telescopic tube" method, which is discussed in the Veystman, et al. reference (see below) and has as its inputs, the particle size distribution resultant from the grinding models, the composite density of the solids, and the presence of additives in the slurry. These are employed as indicated by equation (2) below:

$$\eta = \eta_o\left(1 - \frac{\phi}{\phi_{max}}\right)^{-\eta'\phi_{max}} \quad (2)$$

Where:

$\eta_0$ represents the viscosity of the liquid in the slurry.

$\phi$ represents the volume fraction of solids in the slurry.

$\phi_{max}$ represents the volume fraction of solids in a packed bed condition for the size distribution of the solids, and calculated as indicated in the reference: Veytsman, B. et al, "Packing and Viscosity of Polydisperse Coal Water Slurries", *Energy & Fuels*, Volume 12, 1998, pp. 1031-1039, which is disclosed herein by reference in its entirety and is referred to as the "Veystman, et al." reference.

$\eta'$ represents a constant.

$\eta$ represents the calculated viscosity of the slurry.

Figure 2:
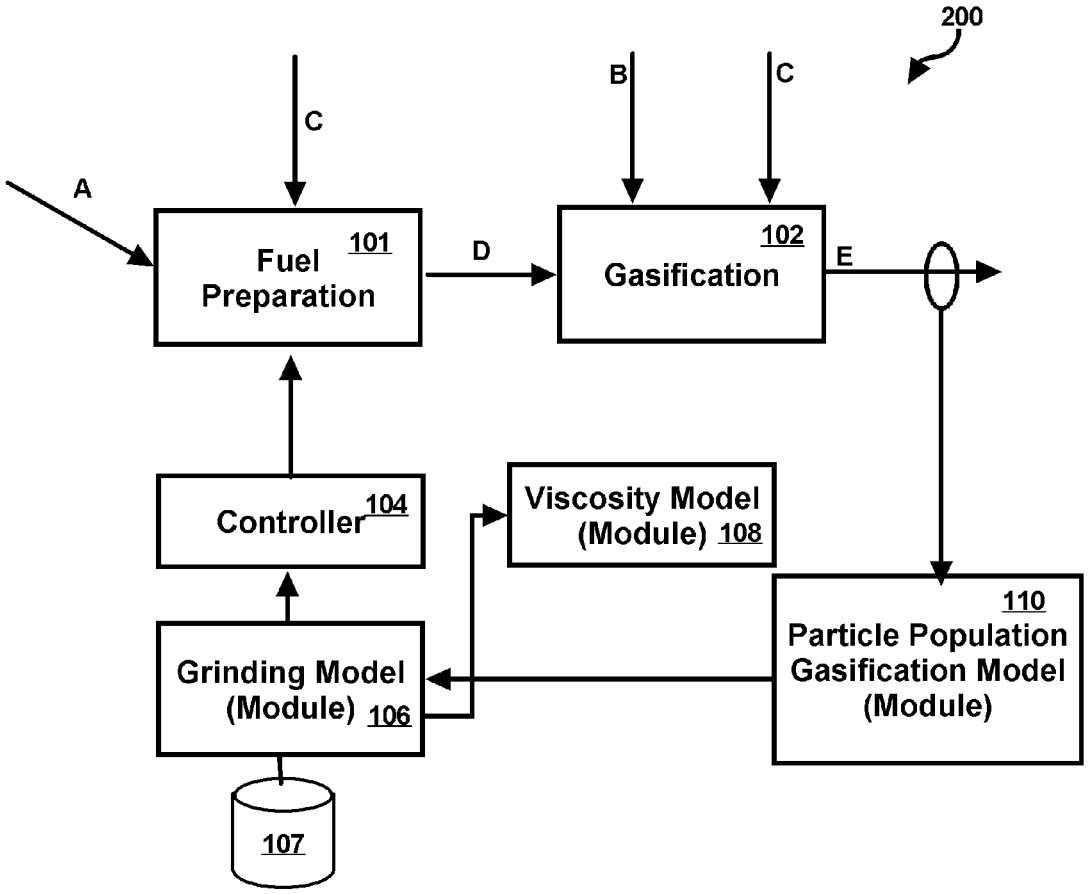
FIG. 2 illustrates a system 200 that includes an assembly of models for use as a control scheme for a gasification plant, in accordance with an embodiment.

FIG. 2 illustrates a system 200 that includes an assembly of models for use as a control scheme for a gasification plant, in accordance with an embodiment. Note that in FIGS. 1-2, identical parts or elements are generally indicated by identical reference numerals. Thus, system 200 generally includes a fuel preparation step/component 101 and a gasification step/component 102. Additionally, a particle population gasification module 110 is indicated in FIG. 2, which generates data that is fed as input to a grinding model 106. The grinding model 106 generally provides instructions for a grinding model, while the module 110 provides instructions for a particle population gasification model. Data from module 106 is fed as input to a viscosity module 108. Data from the grinding module 106 may also be fed as input to a controller 104, which then provides control data as input to the fuel preparation component/step 101.

The combined models may be employed in the context of plant control and operating procedures as follows. A grinding model is preferably developed, which is dependent on the type of mill or plant utilized. The grinding model is provided by the grinding module 106 shown in FIG. 2. For all mills, for example, such a development process may include developing a database 107 that maintains data indicative of particle size and specific gravity distributions across the range of mill conditions encountered in plant operations. Database 107 can be then matched against key mill operating parameters, such as speed, power consumption, and classifier settings. In the case of low speed mills, for example, a procedure to develop breakage functions may be employed, and a model configured around these functions, mill loading, grinding medium charge, mill speed, and power consumption. In either case, specific gravity distributions are developed for the mill products (stream D). The result is a particle population, with a distribution of particle size and specific gravity that is a function of mill operating parameters that are measured in the plant.

The addition of the viscosity model provided by viscosity module 108 provides additional enhancements to system 200. The particle size distribution resultant from the grinding model of module 106 can be utilized to calculate the predicted viscosity of the slurry. Equation (2) above can be modified to fit plant data to accommodate the presence of slurry additives.

The particle population gasification model is provided by module 110. The solids present in stream E from the gasifier can be analyzed for particle size and combustibles content across the particle size distribution. This may be accomplished through batch sampling and analyses, continuous on-line monitoring, or both. The results can be then utilized to modify the weight loss parameter, L(x,y), found in Equation (1) above. Underlying the L(x,y) parameter are kinetic components that calculate weight loss. These are modified iteratively until the data from stream E match the predicted data using the model. Where the gasifier operates under a sufficiently large range of conditions that can affect the kinetic parameters, this procedure may be repeated for different conditions to develop additional values of L(x,y).

Once the aforementioned model information has been developed, the models are assembled and utilized with the control system and operating procedures as follows.

First, using the particle population gasification and grinding models, a feedback relationship is developed that mathematically links the operating parameters of the fuel preparation of the fuel preparation component/step 101, with the flow rate and composition of the solids in stream E. These operating parameters include, for example, mill operating data such as loading, grinding medium charge, feed rate, and power consumption. These parameters may be measured manually, through calculation from other parameters, or automatically through the plant data acquisition system, each method being used either alone or in combination with other methods.

Second, the combined models can be utilized to continuously establish optimum conditions for the fuel preparation step/component 101 that will minimize the combustibles content of stream E. Where the system 200 is operating outside these conditions, the plant control system can be adjusted to alert the plant operators to provide the opportunity to return to acceptable operating parameters.

Third, the particle population developed by the inputs of the grinding module 106, along with water and additive flow rates, can be fed to the viscosity module 108 for processing by the viscosity model. Upper and lower limits can be established for acceptable slurry viscosity. When the predicted viscosity is outside these limits, or if there is a data trend that suggests that the processes in the step/component 101 will produce a slurry that is outside those limits, the plant control system 200 can be adjusted to alert the plant operators to provide the opportunity to return to acceptable operating parameters.

Figure 3:
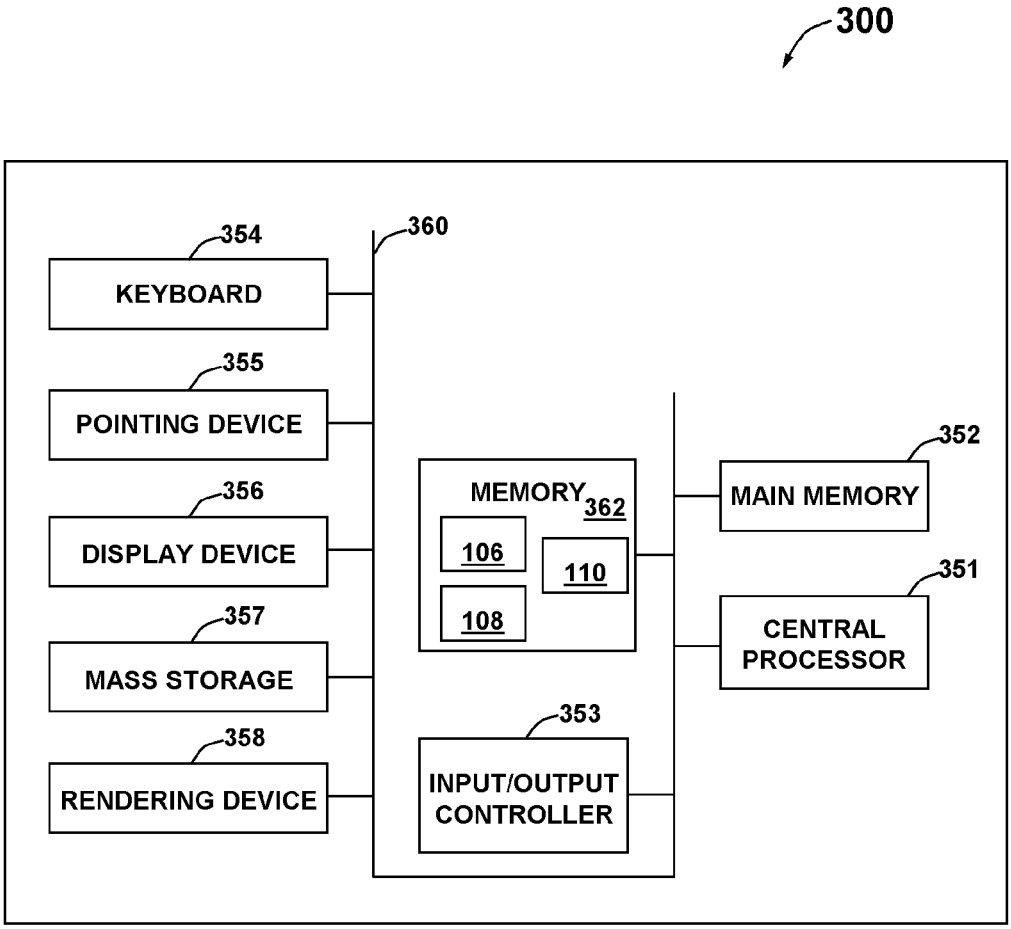
FIG. 3 illustrates a schematic view of a computer system in which the present invention may be embodied.
Figure 4:
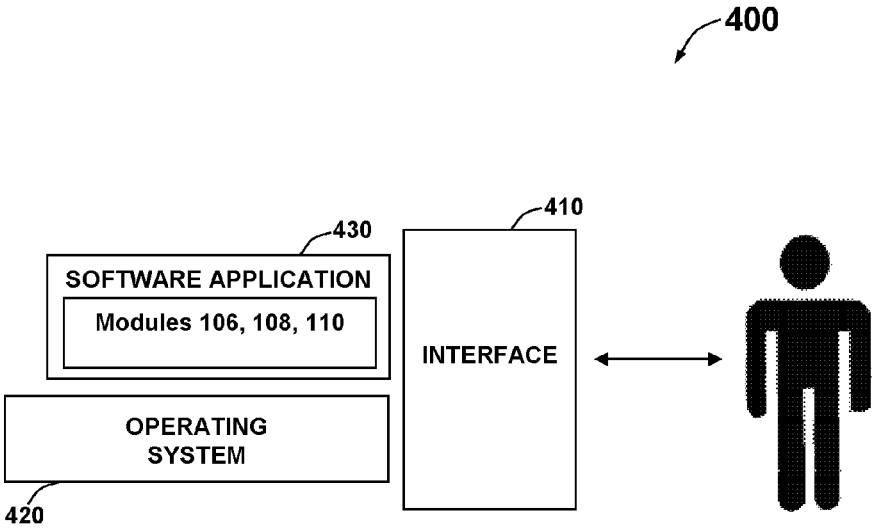
FIG. 4 illustrates a schematic view of a software system including an operating system, application software, and a user interface which may be employed for carrying out an embodiment.
Figure 5:
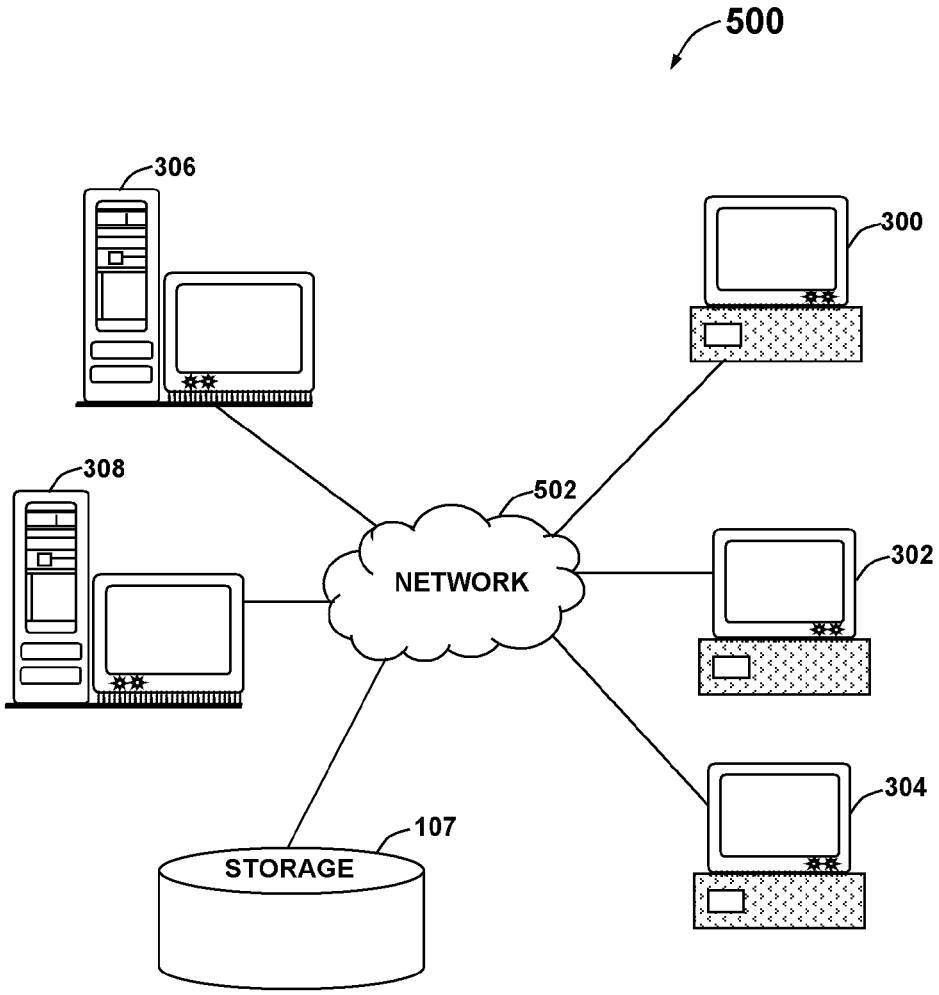
FIG. 5 illustrates a graphical representation of a network of data-processing systems in which aspects of the disclosed embodiments may be implemented.

Note that the following discussion with respect to FIGS. 3, 4 and 5 is intended to provide a brief, general description of suitable computing environments in which the disclosed method and system may be embodied. Although not required, the method and system herein can be implemented in the general context of computer-executable instructions, such as program modules, being executed by a single computer or a series of interconnected computers.

Generally, program modules include routines, programs, objects, components, data structures, etc., that perform particular tasks or implement particular abstract data types. Moreover, those skilled in the art will appreciate that the disclosed method and system may be practiced in the context of other computer system configurations, including handheld devices, multi-processor systems, microprocessor-based or programmable consumer electronics, networked PCs, minicomputers, mainframe computers, and the like.

FIGS. 3-5 are therefore illustrated and described herein as exemplary diagrams of data-processing environments in which some embodiments of the present invention may be implemented. It should be appreciated that FIGS. 3-5 are only exemplary and are not intended to assert or imply any limitation with regard to the environments in which aspects or embodiments of the present invention may be implemented. Many modifications to the depicted environments may be made without departing from the spirit and scope of the present invention.

As depicted in FIG. 3, the embodiments may be implemented in the context of a data-processing apparatus 300 including, for example, a central processor 351, a main memory 352, an input/output controller 353, a keyboard 354, a pointing device 355 (e.g., mouse, track ball, pen device, or the like), a display device 356, and a mass storage 357 (e.g., hard disk). Additional input/output devices, such as a rendering device 358 (e.g., printer, fax, etc), may be associated with the data-processing apparatus 350 as desired. As illustrated, the various components of the data-processing apparatus 300 may communicate through a system bus 360 or similar architecture. It can be appreciated that the data-processing apparatus 300 may be in some embodiments, another type of computing device, such as, for example, a mobile computing device such as a Smartphone, a laptop computer, iPhone, etc. In other embodiments, data-processing apparatus 300 may function as a desktop computer, server, and the like, depending upon design considerations. An additional memory 362 may include one or more modules 106, 108 and/or 110, which are discussed herein with respect to FIGS. 1-2. Memory 362 communicates electronically with system bus 360 and hence the other components of apparatus 300, such as, for example, the controller 353, the processor 351, mass storage 357, display device 356, pointing device 355, keyboard 354, main memory 352, and so forth.

FIG. 4 illustrates a computer software system 400 for directing the operation of the data-processing apparatus 300 depicted in FIG. 3. Software application 430, which may be stored in main memory 352 and also in mass storage 357, generally includes a kernel or operating system 420 and a shell or interface 410. One or more application programs, such as application software 430, may be "loaded" (i.e., transferred from mass storage 357 into the main memory 352) for execution by the data-processing apparatus 300. The data-processing apparatus 300 is capable of receiving user commands and other data through user interface 410; these inputs may then be acted upon by the data-processing apparatus 300 in accordance with instructions from operating system 420 and/or the software application 430, which may include modules 106, 108, and/or 110.

Note that the term module as utilized herein may refer to a collection of routines and data structures that perform a particular task or implements a particular abstract data type. Modules may be composed of two parts: an interface, which lists the constants, data types, variable, and routines that can be accessed by other modules or routines, and an implementation, which is typically private (accessible only to that module) and which includes source code that actually implements the routines in the module. The term module may also simply refer to an application, such as a computer program design to assist in the performance of a specific task, such as, for example, word processing, accounting, inventory management, plant and mill control, etc.

The interface 410, which is preferably a graphical user interface (GUI), also serves to display results, whereupon a user may supply additional inputs or terminate a particular session, if desired. In one embodiment, operating system 420 and interface 410 may be implemented in the context of a "Windows" system. It can be appreciated, of course, that other types of systems are possible. For example, rather than a traditional "Windows" system, other operation systems, such as, for example, Linux, may also be employed with respect to operating system 420 and interface 410. Application module 430, on the other hand, may include instructions, such as the various operations described herein with respect to the various components and modules described herein, such as, for example, those necessary to process the system 200 depicted in FIG. 2 via modules 106, 108, 110, and so forth.

FIG. 5 depicts a graphical representation of a system 500 of networked data processing devices 300, 302, 304, 306, and 308 in which aspects of the present invention may be implemented. Note that in FIGS. 1-5, identical or similar parts or elements are generally indicated by identical reference numerals. Thus, for example, the data-processing apparatus 300 of FIG. 3 is shown in FIG. 5 in the context of system 500. The other data-processing devices 302 and 304 are similar to data-processing apparatus 300. Servers 306 and 308 are also connected to network 500. Network 502 is a network of computers in which embodiments of the present invention may be implemented. Network 502, which is the medium used to provide communications links between various devices and computers connected together within system 500. Network 500 may include connections, such as wire, wireless communication links, internet connections, USB connections, fiber optic cables and so forth. An example of network 500 is the Internet or an organization Intranet.

In the depicted example, server 306 and server 308 connect to network 502 along with database 107. In addition, clients 300, 302 and 304 connect to network 252. These clients 300, 302, and 304 may be, for example, personal computers or networked computer workstations or even laptop computers that communicate with network 502 via a secure wireless communications link. Data-processing apparatus 300 depicted in FIG. 3 can be, for example, a client such as client 302, 304, etc. Alternatively, data-processing apparatus 300 can be implemented as a server, such as servers 306 and/or 308, depending upon design considerations.

In the depicted example, server 306 may provide data, such as boot files, operating system images, and applications to clients 300, 302, and 304. Clients 300, 302, and 304 may be clients to server 306 and/or 308 in this example. System 500 may include additional servers, clients, and other devices not shown. Specifically, clients may connect to any member of a network of servers which provide equivalent content.

In the depicted example, system 500 may be the Internet with network 502 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, government, educational and other computer systems that route data and messages. Of course, system 500 also may be implemented as any number of other types of networks, such as for example, an Intranet, a local area network (LAN), or a wide area network (WAN). FIG. 5 is intended as an example, and not as an architectural limitation for different embodiments of the present invention.

Note that the description of FIGS. 3-5 is presented with respect to embodiments of the present invention, which can be embodied in the context of a data-processing system such as data-processing apparatus 300, computer software system 400 and data processing system 500 and network 502 depicted respectively in FIGS. 3, 4, and 5. The present invention, however, is not limited to any particular application or any particular environment. Instead, those skilled in the art will find that the system and methods of the present invention may be advantageously applied to a variety of system and application software, including database management systems, word processors, and the like. Moreover, the present invention may be embodied on a variety of different platforms, including Macintosh, UNIX, LINUX, and the like. Therefore, the description of the exemplary embodiments, which follows, is for purposes of illustration and not considered a limitation.

It can be appreciated that disclosed embodiments are applicable to a number of different scenarios. For example, such embodiments will find usefulness in plants using solid fuel gasification systems, including but not limited to entrained flow, fluid bed, and transport gasifiers. Such embodiments also find applicability to including, not limited to models with existing and new distributed control systems, local programmable logic controllers, mill controls, batch laboratory analyses of effluent solids and mill inputs and outputs, and continuous and batch on-line instrumentation for measuring solids, liquid, gas/sold multiphase, and slurry flow rates and compositions associated with gasification plants.

Additional applications for the disclosed embodiments include the use of a particle population gasification model involving particle size alone, or including specific gravity, in conjunction with a grinding model using these parameters or with a mill control system in a gasification plant. Another application involves the use of the viscosity model with a grinding model and a control system in a gasification plant.

The disclosed embodiments therefore combine the use of plant parameter measurements with a set of mathematical models to provide a new means of operation of a plant for optimizing the conversion of solids. The disclosed embodiments may be integrated into existing plant control systems and operating procedures, and/or may be employed to develop new or retrofit control systems.

It will also be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fuel gasification control system, said system comprising:

a fuel preparation component and a fuel gasification component, wherein said fuel preparation component receives a fuel for conversion into a stream of prepared fuel, which is supplied to said fuel gasification component for preparation of a gasification product;

a grinding module that predicts a distribution of properties in said stream of prepared fuel based on at least one property of a grinding stimulus and said fuel supplied to said fuel preparation component; and a particle population gasification module that divides solids contained in said fuel into particle size and specific gravity increments to adjust a mass of said solids in each increment for a loss of volatile matter introduced by said fuel gasification component, followed by a calculation by weight loss due to combustion and gasification reactions and thereafter sums a result to provide a composite combustible distribution with respect to said gasification product.

2. The system of claim 1 further comprising a viscosity module that predicts a viscosity of said stream of prepared fuel and maintains said viscosity of said stream of prepared fuel.

3. The system of claim 2 wherein said grinding module, said particle population gasification, and said viscosity module are combined to continuously establish optimum conditions for minimizing a combustible content of said gasification product.

4. The system of claim 1 wherein said grinding module includes a model indicative of particle size reduction and particle size separation associated with said fuel.

5. The system of claim 4 wherein said grinding module further comprises a specific gravity distribution with respect to a particle size distribution developed by said grinding module.

6. The system of claim 1 further comprising a feedback relationship based on data generated by said particular population gasification module and said grinding module, wherein said feedback relationship mathematically links operating parameters of said fuel preparation component.

7. A fuel gasification control system, said system comprising:

a fuel preparation component and a fuel gasification component, wherein said fuel preparation component receives a fuel for conversion into a stream of prepared fuel, which is supplied to said fuel gasification component for preparation of a gasification product;

a grinding module that predicts a distribution of properties in said stream of prepared fuel based on at least one property of a grinding stimulus and said fuel supplied to said fuel preparation component;

a particle population gasification module that divides solids contained in said fuel into particle size and specific gravity increments to adjust a mass of said solids in each increment for a loss of volatile matter introduced by said fuel gasification component, followed by a calculation by weight loss due to combustion and gasification reactions and thereafter sums a result to provide a composite combustible distribution with respect to said gasification product; and a viscosity module that predicts a viscosity of said stream of prepared fuel and maintains said viscosity of said stream of prepared fuel.

8. The system of claim 7 wherein said grinding module includes a model indicative of particle size reduction and particle size separation associated with said fuel.

9. The system of claim 7 wherein said grinding module further comprises a specific gravity distribution with respect to a particle size distribution developed by said grinding module.

10. The system of claim 7 wherein said grinding module includes a model indicative of particle size reduction and particle size separation associated with said fuel and wherein said grinding module further comprises a specific gravity distribution with respect to a particle size distribution developed by said grinding module.

11. The system of claim 7 further comprising a feedback relationship based on data generated by said particle population gasification module and said grinding module, wherein said feedback relationship mathematically links operating parameters of said fuel preparation component.

12. The system of claim 11 further comprising a feedback relationship based on data generated by said particle population gasification module and said grinding module, wherein said feedback relationship mathematically links operating parameters of said fuel preparation component.

13. The system of claim 7 wherein said grinding module, said particle population gasification, and said viscosity module are combined to continuously establish optimum conditions for minimizing a combustible content of said gasification product.

* * * * *